United States Patent [19]

Canalizo

[11] 4,405,291

[45] Sep. 20, 1983

[54] DOWNHOLE DOUBLE ACTING PUMP

[75] Inventor: Carlos R. Canalizo, Dallas, Tex.

[73] Assignee: Otis Engineering Corporation, Dallas, Tex.

[21] Appl. No.: 456,366

[22] Filed: Jan. 7, 1983

Related U.S. Application Data

[63] Continuation of Ser. No. 152,529, May 22, 1980, abandoned.

[51] Int. Cl.[3] ..... F04B 47/08

[52] U.S. Cl. ..... 417/393; 417/91; 91/313; 91/329; 91/344

[58] Field of Search ..... 91/313, 344, 329; 417/393, 91

[56] References Cited

U.S. PATENT DOCUMENTS

| | | | |
|---|---|---|---|
| 1,448,486 | 3/1923 | Garraway | 91/313 X |
| 2,427,703 | 9/1947 | Berkey | 417/91 |
| 2,642,045 | 6/1953 | Potts | 91/329 X |
| 2,726,605 | 12/1955 | Tebbetts | 417/91 |
| 2,787,223 | 4/1957 | Sargent | 91/313 X |
| 2,799,225 | 7/1957 | Schoen | 91/313 X |
| 2,821,141 | 6/1958 | Sargent | 91/313 X |
| 2,948,224 | 8/1960 | Bailey | 417/393 |
| 3,064,582 | 11/1962 | Knights | 417/393 X |
| 3,791,768 | 2/1974 | Wanner | 91/329 X |
| 3,963,377 | 6/1976 | Elliott et al. | 417/91 X |

*Primary Examiner*—Leonard E. Smith
*Attorney, Agent, or Firm*—Vinson & Elkins

[57] ABSTRACT

A down hole pump operated by gas in which the fluid in the production conduit may first be gas lifted. The exhaust gas from the pump aerates the well fluids in the production conduit. The pump is controlled by a valve whose operation is in turn controlled by a pilot valve shiftable in response to operation of the pump.

5 Claims, 13 Drawing Figures

14
16

90a
90

95
114
93
142
108
92
116
94
300a
301a
117
112
90b
10'
60'
300
156
58'
91
154
301
302
48'
128
36'
124
130a
92
134a
118a
112
52'

90
156
186
42
94
208
99a
123
178
160
176
274
206
202
99
97
191
270
98
131
174a
192
200
174b
150
120
151
190a
272a
180
166
272b
92
122
188
133"
189
190
172a
172b
207
184
154
152
96
164

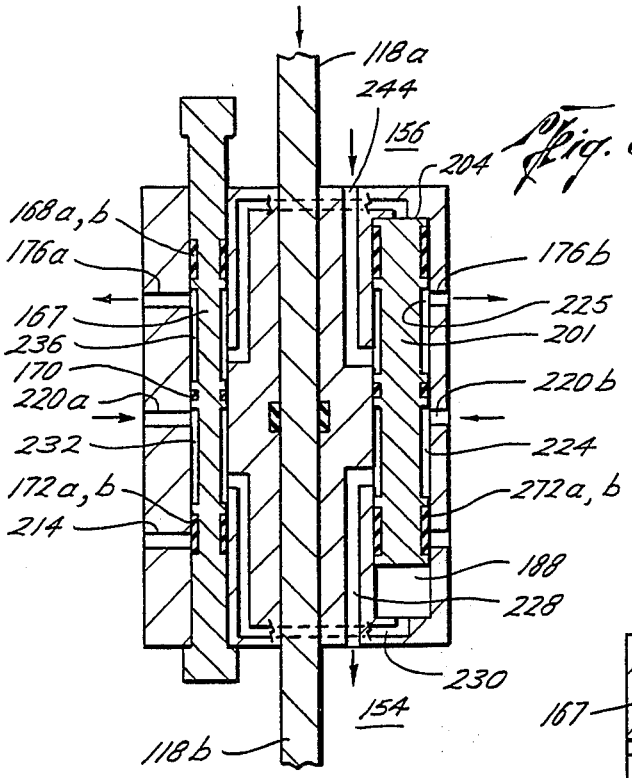
Fig. 8A
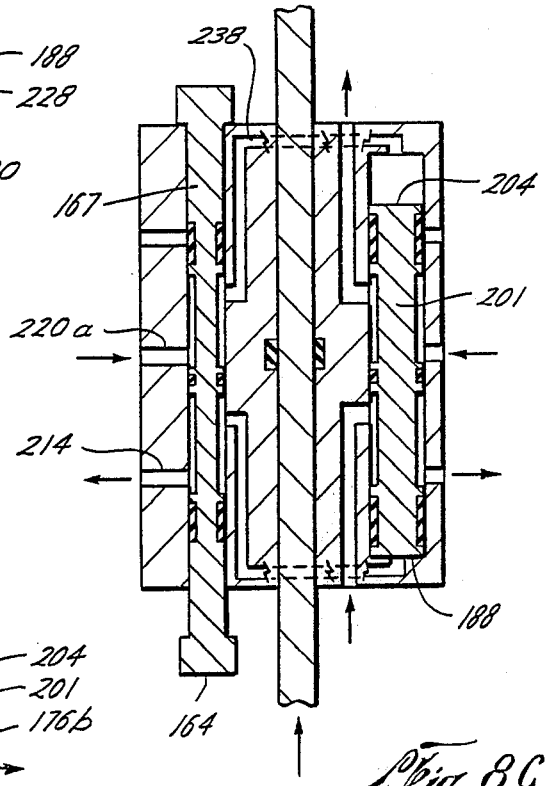
Fig. 8C
Fig. 8B
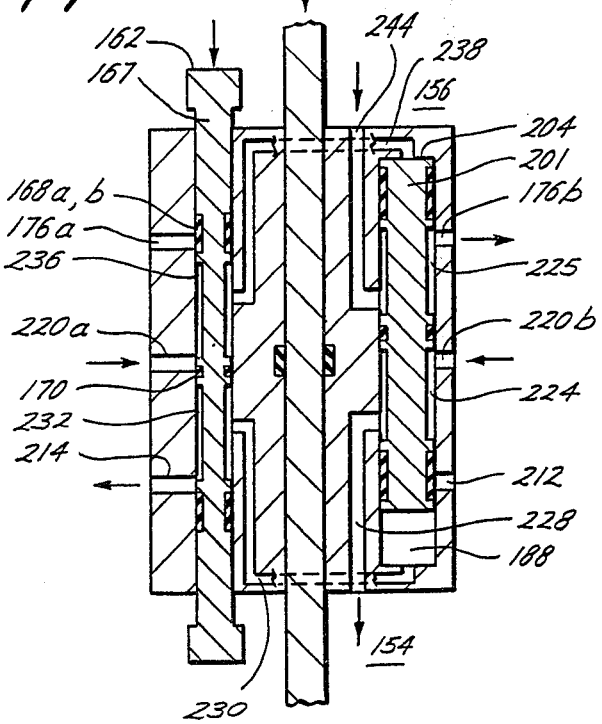

DOWNHOLE DOUBLE ACTING PUMP

This is a continuation of copending application Ser. No. 06/152,529, filed May 22, 1980, now abandoned.

BACKGROUND OF THE INVENTION

1. Field of the Invention

The invention is directed to a downhole double acting pump for use in wells. More particularly, the invention is directed to a downhole double acting pump for pumping well fluids from a reservoir to the surface of the well.

2. Prior Art

In the production of well liquids it is often necessary to utilize means, other than reservoir energy, to lift the liquids to the surface of the well. Various methods have been used for this purpose, including pumps that are placed within the bore of production tubing extending into the production zone. The pump would be located below the surface of the well liquids and driven by some external force to force the liquids to the surface of the well.

Typical of the prior art pumping devices is the pump taught in U.S. Pat. No. 3,617,152, issued to Leslie L. Cummings. There is shown an automatic well pump utilizing compressed power air or gas to displace well production liquids from the well bore. This pump is referred to in the art as a single action pump and requires relative high pressures in order to lift well liquids to the surface of the well.

A well pump requiring hydraulic pressure for operation is taught in U.S. Pat. No. 4,084,923, issued to George K. Roeder. In this pump, the pistons are driven by more than one engine. The invention uses a hollow piston rod to supply power fluid to a lower engine.

It has been a goal of those skilled in the art to develop a double acting pump that will operate on a relatively small power requirement and which could be placed at relatively deep depths in a well. In addition, it would be desirable to provide a pump which could be used in through the flow line (TFL) serviced wells. This would allow use of the pump in a plurality of wells which have flow lines terminating at a single production platform, such as found in off-shore oil production.

OBJECTS OF THE INVENTION

It is an object of this invention to provide a method and system of operating a down hole pump which is gas driven and which will operate in wells in which the hydrostatic head of liquid in the tubing prior to beginning the operation of the pump system exerts a greater pressure per square inch than does the operating gas.

Another object is to provide a method and system for operating a well pump in which fluid in the tubing is gas lifted until the column is light enough that the pump may operate against the back pressure exerted by the liquid in the tubing.

Another object is to provide a well pump in which the gas after operating the pump is mixed with the fluids being pumped to aerate the well fluids as they pass up the tubing.

Another object is to provide a double acting pump having control means which has no dead spots and is positive in its operation.

Another object is to provide a double acting pump which will not pound.

Another object is to provide a well pump in which the speed of the pump may be controlled from the surface.

Another object is to provide a well pump in which the well fluids are not relied upon to move the pump parts but the pump parts are all moved positively by the force of the power gas.

SUMMARY OF THE INVENTION

A gas operated down hole pump operated in a manner in which the exhaust power gas and liquids being pumped are mixed as they leave the pump to aerate the liquids thus reducing the hydrostatic head against which the pump is operating.

This pump may be installed in a tubing having gas lift valves above the pump which may first lift the fluid above the pump to the surface to reduce the back pressure to a value at which the pump may be operated by a relatively low power gas pressure.

A downhole double acting pump comprising a tubular housing, a valve body positioned in the intermediate portion of said housing with an upper chamber above and a lower chamber below said valve body within said housing, a piston positioned within each of said chambers to provide in said upper chamber an upper pumping chamber and a upper pressure chamber and in said lower chamber a lower pumping chamber and a lower pressure chamber, means connecting the pistons, means supplying fluid under pressure to the valve body, a pressure responsive main valve in said valve body to control direction of fluid to one of said pressure chambers while exhausting the other pressure chamber, a pilot valve engageable by said pistons at the end of their inward strokes controlling the flow of fluid to the pressure responsive portion of said main valve to cause it to move changing the flow of fluid from and to the pressure chambers, and said pumping chambers having check valve means to control well fluids entering and exiting said chambers.

In a preferred embodiment of the invention, exhaust gases emitted from the pump are directed to the production tubing, above the pump, to aerate the well liquids to aid in pumping same to the surface of the well.

In practicing the method of this invention a gas operated well pump is installed on the lower end of the tubing string and run in the well to the appropriate depth for pumping well fluids to the surface. The installation may be of any conventional form and may or may not include a packer packing off the casing-tubing annulus. If the installation includes a packer then the annulus may be used if desired to provide a conduit for conducting gas from the surface to the pump to operate the pump. If the annulus is not used for this purpose then an auxiliary conduit is provided to conduct gas to the pump. In either event, if the pump is to be placed under a substantial head of fluid, gas lift valves will be included at spaced intervals along the tubing. This, if the pump is submerged below a level of fluid which would prevent its operation by exerting a greater back pressure than the pump is capable of overcoming, the gas lift valves could be utilized in the conventional manner to first gas lift the fluid within the tubing to the surface to an extent such that the back pressure exerted by the hydrostatic head of fluid would be reduced to the point at which the pump will be capable of operating. After lifting with gas lift valves the injection pressure could be reduced in the conventional manner, to close the gas lift valves to direct all of the power gas to the pump.

In accordance with this invention, the power gas is first utilized to operate the pump and lift well fluids, and then the exhaust gas from the pump is mixed with the fluids being lifted to lighten the column of fluids in the tubing so that the back pressure exerted by the fluids being lifted is greatly reduced. This permits a gas operated pump to be used in many instances where it could not otherwise be used due to the height of fluid in the well or due to limitations on the availability of gas of a sufficient pressure to operate the pump.

It will be understood that while it is contemplated that the gas lift valves will be closed during normal operation of the pump they could be operated simultaneously with the pump and thus a portion of the injected gas would be used to operate the pump and then aerate the column of fluid being pumped while another portion of the gas would be used solely to aerate the well fluids.

BRIEF DESCRIPTION OF THE DRAWINGS

FIGS. 8A–C are schematic sectional views of the valve body of the invention showing sequencing of the pilot and main valve in operation of the pump.

DETAILED DESCRIPTION OF THE PREFERRED EMBODIMENTS

Figure 1:
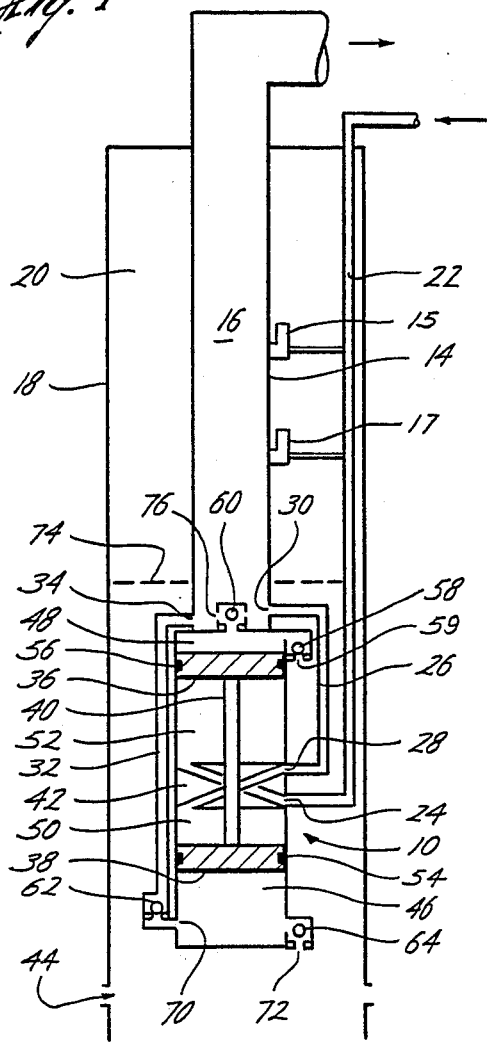
FIG. 1 is a schematic view in section, of a well pump installation embodying the invention.

In FIG. 1, there is schematically depicted a well having a casing 18 and production tubing 14 positioned therein and extending below the surface 74 of well liquids. Well liquids enter the casing 18 through perforations 44 in the casing 18. Positioned within the bore 16 of the tubing 14 is one embodiment of the downhole pump, generally designated by the numeral 10. A suitable fluid for powering the pump 10 is transmitted to the pump 10 by conduit 22 extending to the pump 10 from the surface of the well.

Typically, the pump 10 of the invention includes a tubular housing, adapted to be received within the bore of a suitable landing nipple 90, as depicted in FIGS. 3A–D, which would be made up in the tubing string 14. A valve body 42 for directing fluid flow in the housing is positioned within the housing to provide upper chambers 48 and 52 and lower chambers 46 and 50.

A piston 36 is positioned in the upper chambers to provide an upper pumping chamber 48 and an upper pressure chamber 52. In like manner, there is positioned in the lower chambers a piston 38 to provide a lower pump chamber 46 and a lower pressure chamber 50. Pistons 36 and 38 are preferably connected to a piston rod 40 which extends through the valve body 42.

Well liquids enter the lower pumping chamber 46 through flow passage 72 housing a check valve 64. This is done on upward movement of the piston 38, which expands lower pumping chamber 46 and unseats check valve 64. The lower pressure chamber 50 would be exhausting at this time, with the exhaust being directed by the valve body 42 through a suitable passageway 28 into a conduit 26. The exhaust exiting the valve body via conduit 26 would preferably enter the tubing 14 at a suitable entry port 30. The exhaust fluid entering the tubing 14 at the entry port 30 would provide aeration to well liquids being lifted to the well surface, enhancing the lifting capability of the pump 10 by reducing the fluid column pressure, resulting in a lower supply gas pressure.

During the upward movement of the piston 38, which is now filling pumping chamber 46, the piston 36 is pumping out the well liquids collected in pumping chamber 48. Well liquids exiting cage 76 have unseated the check valve 60 therein and caused check valve 58 to close the upper pumping chamber 48 well liquids entry port 59. Power fluids from the well surface are directed through conduit 22 into valve body passageway 24 and thence into upper pressure chamber 52. Thus, the expansion of the upper pressure chamber 52 causes upward travel of piston 36 and emptying of upper pumping chamber 48.

Reversal of the stroke of the piston rod 40 is caused by valving contained in the valve body 42, which will be discussed in detail hereinafter. However, well liquids exiting the lower pumping chamber 46 enter cage 70 and pass the check valve 62 housed therein. These exiting well liquids then traverse suitable conduit 32 and enter the tubing 14 at a point 34, preferably located above the pump 10.

Figure 2:
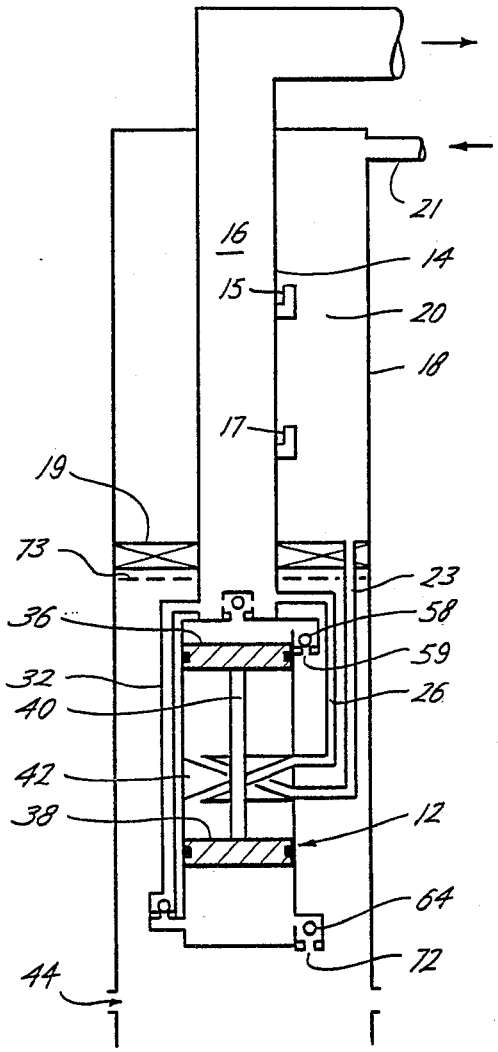
FIG. 2 is a schematic view in section, of a well pump installation employing an alternative embodiment of the invention.

Another embodiment of the installation of the invention is illustrated in FIG. 2, wherein suitable pack off means 19 is positioned on the tubing 14 above the pump 12. Placing the pack off means 19 in this position permits the tubing-casing annulus to be pressured for operation of the pump 12. To accomplish this, fluid communication is established through the pack off means 19 from above same to provide power fluid entry to conduit 23 which communicates power fluid to the pump 12. In all other respects, the pump 12 operates in the same manner as the pump installation shown in FIG. 1.

In addition to the installation embodiments of the invention shown in FIGS. 1 and 2, additional features could be added thereto. For example, gas lift mandrels and valves 15 and 17 could be installed above the pump 10, in the tubing string 14. These valve and mandrels may be those shown at pages T337 and T338 of the 33rd Revision of "Composite Catalog of Oil Field Equipment and Services". Similarly, such gas lift mandrels could be placed in the tubing string 14 above pack off means 19 (FIG. 2). Gas lift valves (not shown) placed in such gas lift mandrels could be used to assist in lifting the well liquids to the surface of the well. Gas lift mandrels and valves are well known in the art.

Referring to FIGS. 3A–D, there is illustrated a landing nipple 90 which would be suitable for receiving the double acting pump 10; shown received therein. The landing nipple 90 as illustrated, is made up of an upper box sub assembly **90*a*, threaded to receive a pin end of a tubing member 14. Sub assembly 90*a* has positioned thereon the upper terminal weldment 93 for receiving a by-pass conduit 92 through which well liquids are pumped to the tubing 14** and lifted to the well surface.

Also positioned on the sub assembly 90*a* is the upper terminal weldment 95 for receiving an exhaust fluid conduit 94 which conducts the exhaust from the pump to the tubing 14 for aeration of the well liquids being lifted to the surface of the well in the tubing 14.

For purposes of assembly, the landing nipple 90 illustrated in FIGS. 3A–D is made up with sub assemblies 90*a*, 90*b*, 90*c*, 90*d* and 90*e*. There is shown disposed in the landing nipple 90 the pump 10' of the invention. The nipple sub assembly 90*c* is partially cut away, in FIG. 3C, to illustrate the exterior of the pump 10' in relation to the interior of the nipple 90. In this manner, it is seen that there is provided a series of honed bores 100, 102, 104 and 106 within the bore of the nipple 90. The pump 10' carries a series of seals 144, 145, 146 and 147 that seal against the honed bores 100, 102, 104 and 106, respectively. In this manner there are provided a series of pressure zones 123, 121 and 122. Pressure zones 122 and 123 are for receiving exhaust fluids from the pump. Pressure zone 121 receives pressure fluid, typically gas under pressure from the surface of the well, in order to drive the pump 10'.

In alternating strokes of the pump 10', exhaust gas leaves the interior of the pump in either pressure zone 122, through port 180 and thence into weldment passage 120 and through conduit 94 to the weldment 95 into the tubing 14; or pressure zone 123, through port 178 into weldment passage 120 and through conduit 94 thence to the tubing 14, as before. The pressurized power gas enters pressure zone 121 through port 98.

Figure 4:
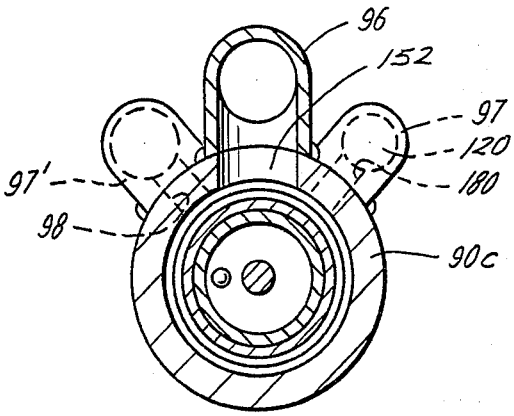
FIG. 4 is a horizontal cross-sectional view taken on the line 4—4 of FIG. 3C.

FIG. 4 illustrates the positioning of well liquid by-pass weldment 96 on the nipple sub assembly 90*c*. There is also shown the exhaust weldment 97 and the power gas weldment 97'.

Referring again to FIGS. 3A–D, exhaust gas exiting the pump 10' enters pressure zone 123 through upper pump housing exhaust ports 133. The exhaust gas exiting the pump 10' into pressure zone 122 exits through the lower pump housing exhaust ports 133'. Power gas, from the surface of the well, enters the pressure zone 121 through nipple port 98 and enters the pump 10' through the pump housing power ports 131.

Figures 3A, 3B:
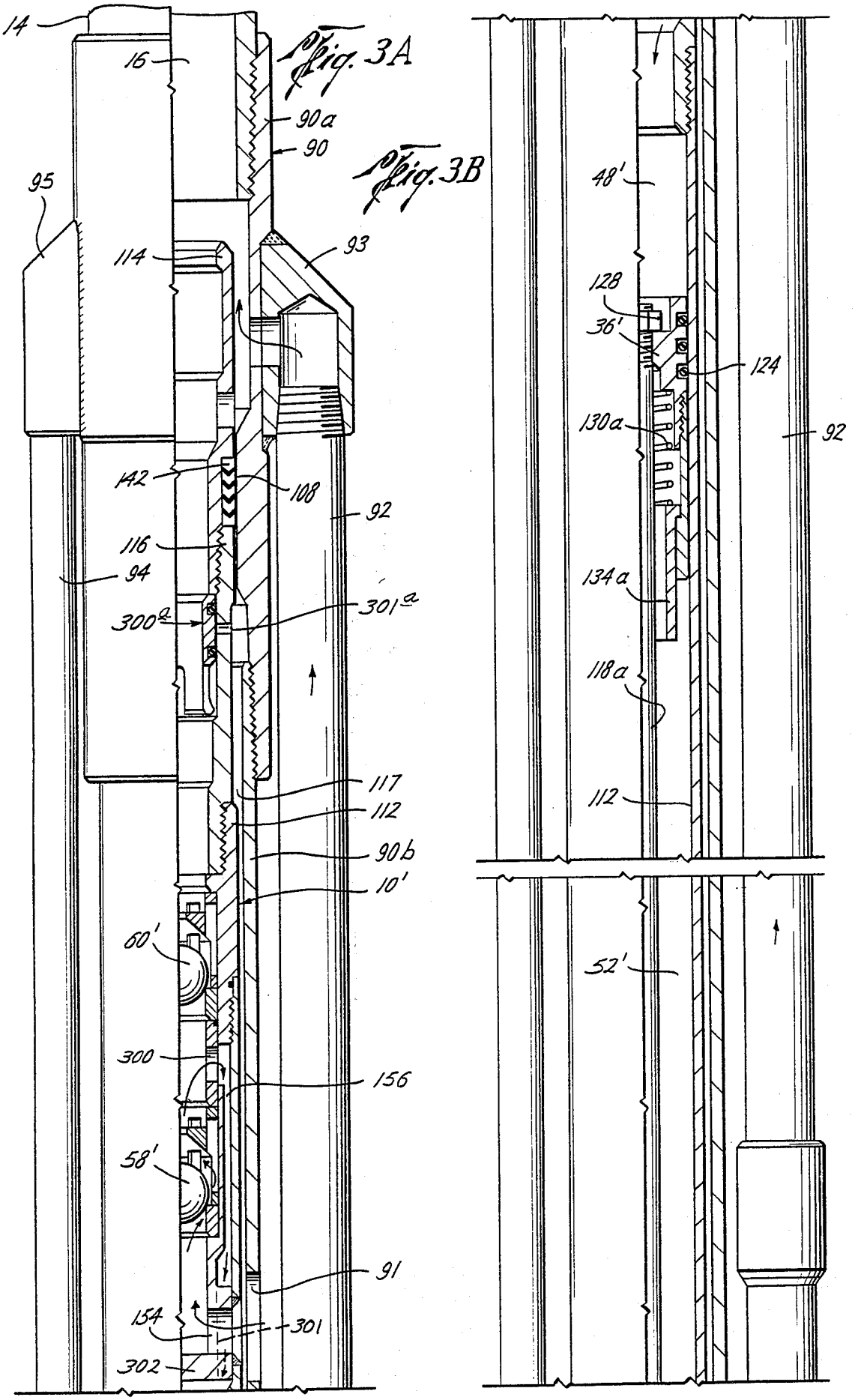
FIGS. 3A–D are quarter sectional, vertical views of a landing nipple, connected in a tubing string, housing the double acting pump of the invention, which is shown partly in elevation and partly in section.

Power gas entering the pump 10' causes reciprocation of the pistons 36' and 38'. The upper piston 36' is shown in FIG. 3B to be connected to the piston rod 118*a* by means of a fastener 128 or other suitable means. The piston 36' carries at least one seal means 124 to seal off the upper pumping chamber 48' from the upper pressure chamber 52'. There is illustrated, however, a plurality of seal means 124 carried on the piston 36'.

A resilient urging means, shown to be a spring 130*a*, is associated with the lower surface of piston 36', to provide for a cushioning of the piston 36' travel toward the valve body 42. A spring guard 134*a* retains the spring 130*a* within the upper piston 36'. As the upper piston 36' travels toward the valve body 42, the spring guard makes contact with the upper end 162 of the pilot valve 160 and moves the pilot valve to the position illustrated in FIG. 5. The spring 130*a* allows for continued travel of the piston 36', without damage to the pilot valve 160, during the period of time required for directing power gas to the upper pressure chamber 52'.

The lower piston 38' carries seal means 126, a spring 130*b*, or other resilient urging means, and a spring guard 134*b* in the same manner as the upper piston 36'.

In the pump 10' stroke sequence shown in FIGS. 3A–D, the piston rod 118*a* and 118*b* is moving downward, with the power gas, entering the valve body 42 through pump housing power ports 131, being directed into the lower pressure chamber 50'. The power gas in the lower pressure chamber 50' acts on the piston 38' to move the piston 38' downward, emptying the lower pumping chamber 46'. The well liquids previously collected in lower pumping chamber 46' exit the pumping chamber 46' following the flow path indicated by arrows. The check valve ball 62' is thus unseated, while the lower well liquid entry check valve 64' is closed. The well liquids from the lower pumping chamber are directed to the by-pass weldment 96 and enter same through port 152 in the nipple housing 90*c* (shown in FIG. 3C). Well liquids exiting the lower pumping chamber 46' do so through port 128 and then enter the annulus 127 between the pump 10' and the nipple 90 (shown in FIG. 3D).

The well liquids are confined to the annulus 127 by the lower pump seal 140 being in sealing engagement with a honed bore 107 on the inside surface of the nipple sub assembly 90*c*. The honed bore 107 projects inwardly from the nipple sub assembly 90*c* to form a no-go surface 110 upon which rests the pump 10'.

The upper pumping chamber 48' is shown to be filling with well liquids entering the chamber 48' through a nipple port 91 and pumping chamber port 303. The well liquids follow the path shown by the arrows in entering the upper pumping chamber 48'. Thus, well liquids unseat the check valve ball 58. Check valve ball 60' is held on its seat by the head of fluid in tubing 14. Well liquids enter the annulus 156 through a port 300 and move thence through the passageway 301 shown in dashed lines in spider 302 into chamber 48'.

Well liquids entering the nipple 90 through the nipple port 91 are confined within an annulus area 117, between the pump 10 and the nipple 90, by the sealing action of the upper pump seal 142 being in contact with a honed bore 108 on the inside surface of the nipple sub assembly 90*a* (as shown in FIG. 3A).

Further, in the illustrated pumping sequence, the upper pressure chamber 52' is being exhausted via the upper exhaust zone 123, as described above.

The double acting pump of the invention may be set in the landing nipple 90, or retrieved therefrom, by known wire line techniques. For this purpose, the double acting pump 10' has positioned at its upper end a fishing neck 114 that would be engageable by fishing tools standard in the industry. There is also illustrated equalizing means 300*a*, shiftably mounted in the upper sub assembly 116 of the pump 10'. Shifting of the equalizing means 300*a* downward would open an equalizing port 301*a*, which would equalize the pressure between the tubing bore 16 and the annulus between the pump 10' and the landing nipple 90 below the seal means 142.

Figure 5:
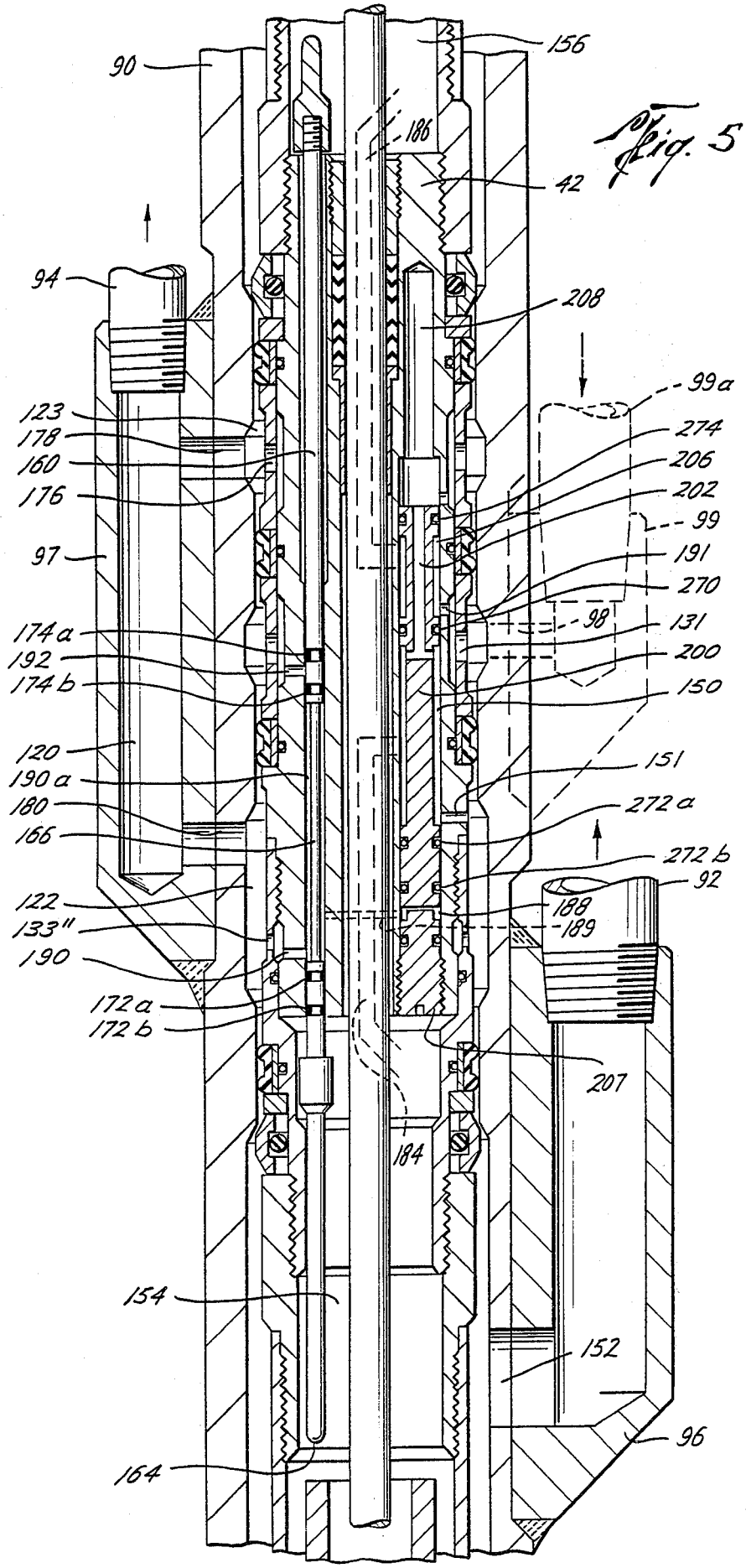
FIG. 5 is a plan sectional view of the valve body, of one embodiment of the invention, within the pump housing as positioned in a landing nipple.
Figure 6:
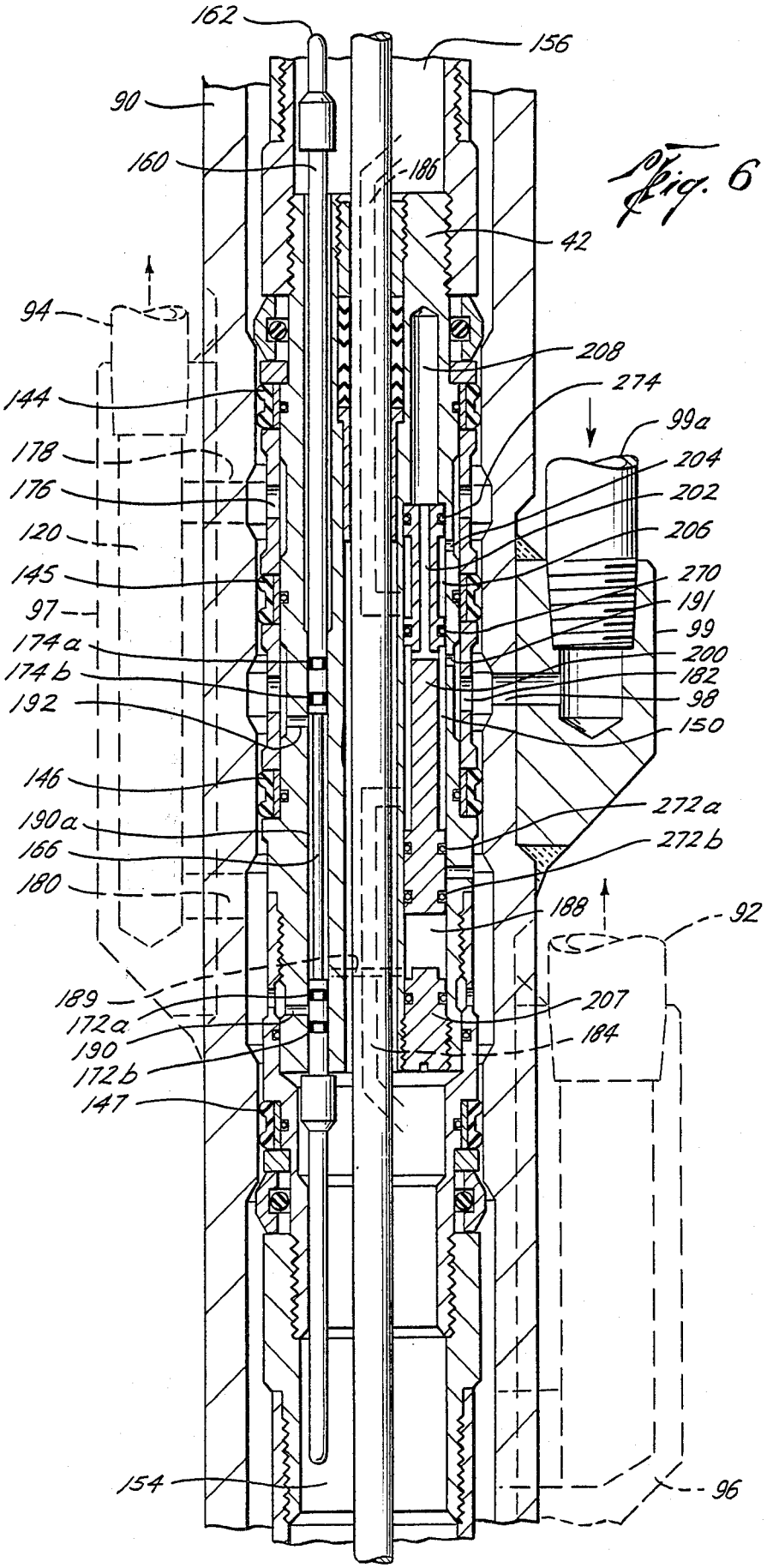
FIG. 6 is a plan sectional view of the embodiment, illustrated in FIG. 5, showing the reverse stroke of the pump.
Figure 7:
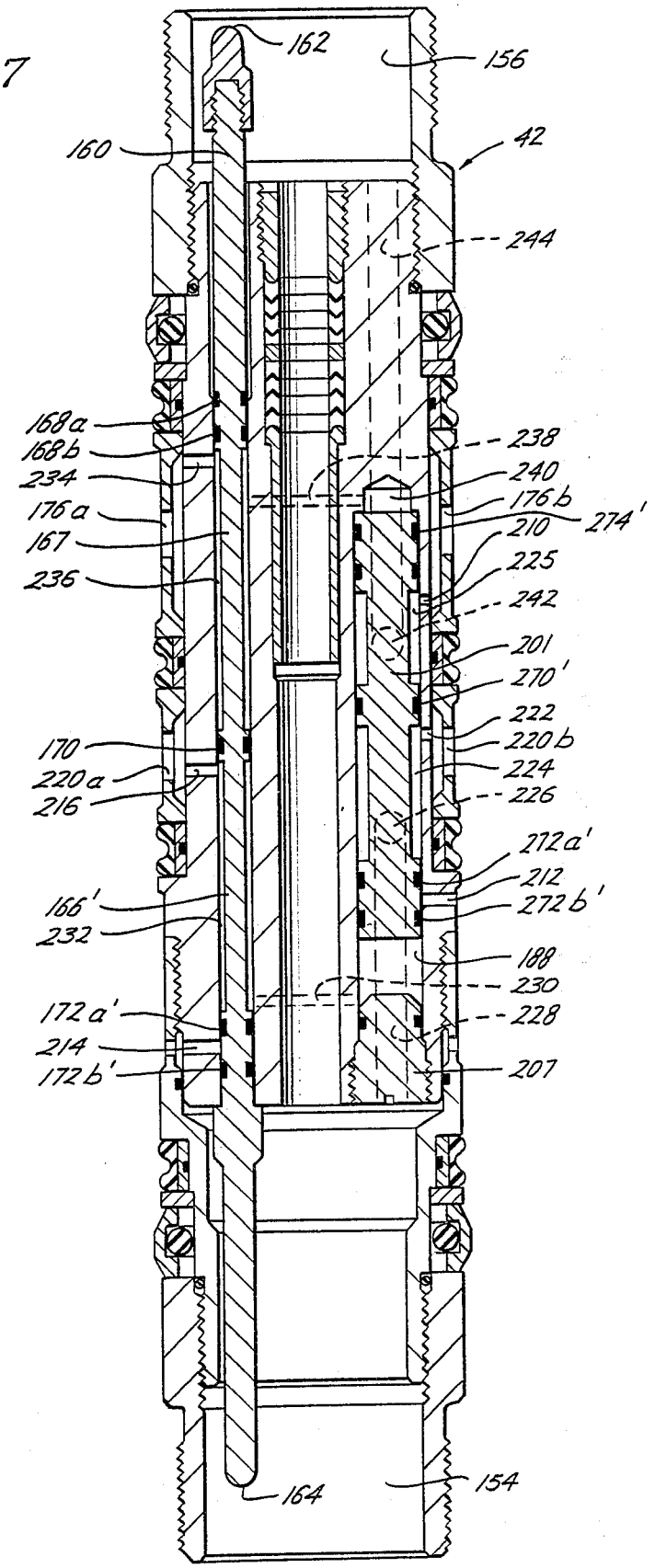
FIG. 7 is a plan sectional view of the valve body of the preferred embodiment of the invention.

FIGS. 5 and 6 should be viewed together in order to better understand the operation of the pilot valve 166 and main valve 200 in controlling the pumping sequence of the double acting pump of the invention. The main valve 200 of FIGS. 5 and 6 is but one embodiment of the invention. The configuration of the pilot valve 166' and main valve 201 of FIG. 7 is the preferred embodiment of the invention.

Referring to FIG. 5, the pistons (not shown) are moving from bottom to top, with the upper pressure chamber 156 receiving power gas via passageway 186 in the valve body (shown in dotted line). As discussed previously, the power gas is conducted to the landing nipple 90 via suitable conduit 99*a*, which terminates at weldment 99. The power gas enters the pump valve body 42 first through nipple port 98 and then valve body ports 131 and 191 into cavity 206.

The main valve 200 is shifted in response to shifting of the pilot valve 166. In the embodiment illustrated in FIGS. 5 and 6 this is accomplished by applying a differential pressure across main valve 200. Downward movement of the main valve results from the application of power gas to the opposite ends of the main valve (chambers 208 and 188) and in response to movement of pilot valve 166 venting the lower chamber 188 to exhaust gas pressures. The resulting differential drives the main valve down and directs power gas to the lower pressure chamber 154. As the main valve 200 moves to its lower position the upper chamber 208 is vented to exhaust gas pressure to again balance forces across the main valve 200. Shifting of the pilot valve to its upper position pressurizes this lower chamber with power gas to again create a differential pressure across the main valve driving it to its upper position in which the upper chamber is again connected to the power gas to again balance the main valve.

With the pilot valve 166 shifted to its lower position seals 174*a* and 174*b*, carried on the pilot valve 166, operate to block the valve body power gas port 192 and direct power gas to cavity 206. In this position, pilot valve cavity 190*a* permits communication between exhaust port 190 and passageway 189, exhausting main valve chamber 188. Power gas entering the main valve is directed through valve body passageway 186 into the upper pressure chamber 156 to move the upper piston (not shown) to empty the upper pumping chamber (not shown).

In this same sequence, exhaust gas from the lower pressure chamber 154 escapes through valve body passageway 184 into an intermediate area 150 of the main valve 200. This intermediate area 150 is confined between seal means 270 and 272*a* carried on the main valve 200. The exhaust gas exits this intermediate area 150 through a main valve passageway 151 into the lower exhaust zone 172 and through port 180 into the exhaust nipple weldment 97, whose interior passageway 120 communicates with the tubing (not shown) through the conduit 94, as explained above.

The equalizing passageway 202 in the main valve communicates between the upper cavity 208 and the main valve passageway in area 150. In the position shown, the upper cavity is exhausted through passageway 202 into area 150 and out through port 151 at the same time that the gas is exhausted from the lower chamber 54. Simultaneously, the upper cavity 208 is also exhausted through upper valve body port 204, and fluids therefrom are directed to the bore of the tubing 14 containing well liquids, as previously described.

With the shifting of the pilot valve 176 to the position illustrated in FIG. 5, and with the main valve 200 in its upper position (see FIG. 6), a differential pressure is created due to power gas occupying the main valve chamber 208 while lower chamber 188 is exhausted. As a consequence, the main valve 200 moves downward until it contacts the lower valve stop 207. In the process of moving downward, the main valve 200 must force out exhaust gas in the space 188 between the valve 200 and the valve stop 207. This expelled exhaust gas passes through a valve body passageway 189 which provides communication between the space 188 and a cavity 190*a* surrounding a lower portion of the pilot valve 166. The exhaust gas is confined within the pilot valve cavity 190*a* by sealing means 172*a* and 174*b* carried on the pilot valve 166. The exhaust enters the lower pressure zone 122, from the pilot valve cavity 190*a*, through valve body ports 190 and 122".

Figure 3C:
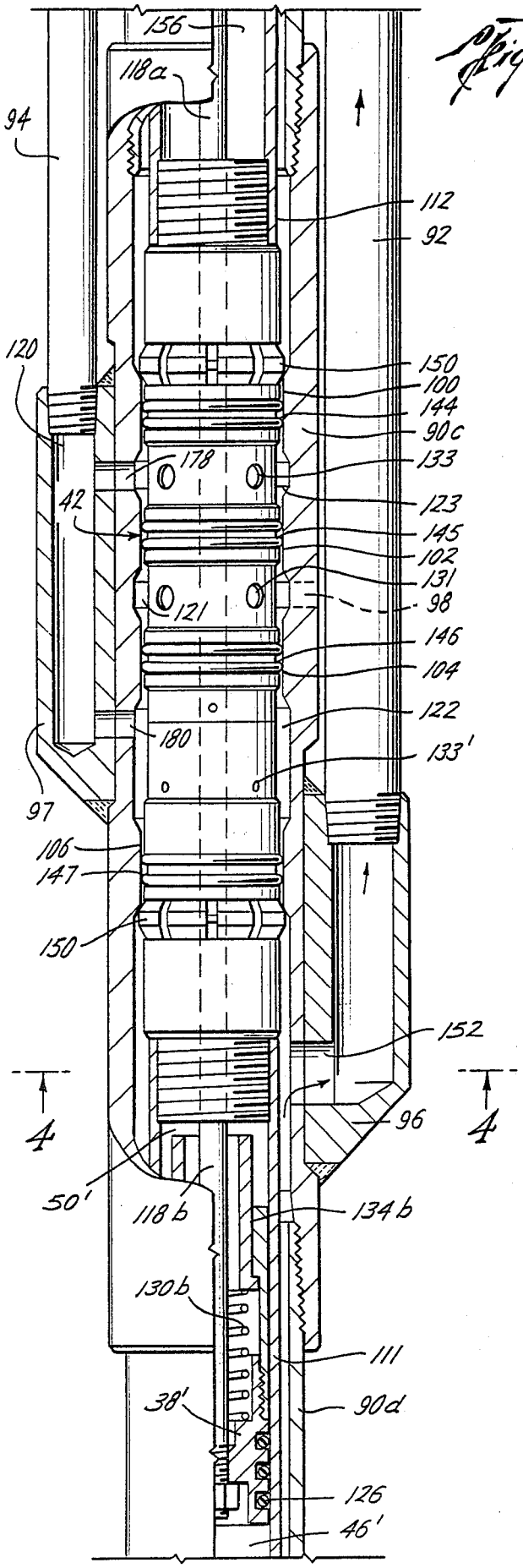
Figure 3D:
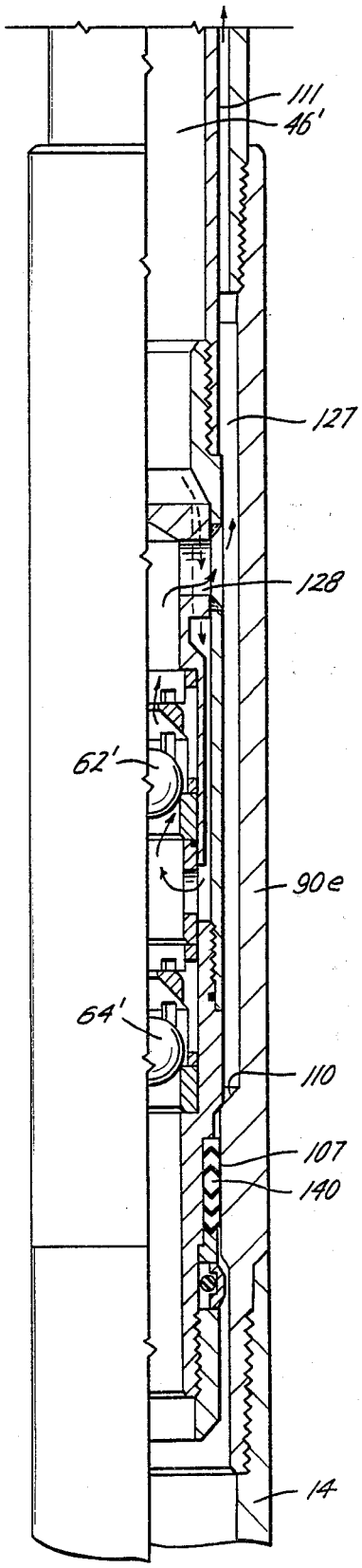

Once the pistons (not shown) reach their upper limit of travel, the reverse stroke is initiated by virtue of the pilot valve 166 being shifted to its opposite position, as illustrated in FIG. 6. This sequence is started by the piston, as illustrated in FIG. 3C, making contact with the lower end 164 of the pilot valve 166, as described above.

Movement of the pilot valve 166 to the upper position has moved spaced apart seals 174*a* and 174*b*, carried therein, to unseal power gas entry port 192. In this manner, power gas has now invaded the lower pilot valve cavity 190*a*, between seals 174*b* and 172*a*, where it is directed to the space 188, between the lower end of the main valve 200 and the main valve stop 207, via the main valve passageway 189. This causes the main valve 200 to be shifted to its upper-most position closing port 204 as illustrated in FIG. 6, and power fluid is again directed through passage 202 into upper chamber 208.

Thus shifted, the power gas is now directed to the lower pressure chamber 154 to force the lower piston (not shown) downward to empty the lower pumping chamber (not shown). The power gas, from conduit 99*a* entering power gas weldment 99, entering the nipple 90 through nipple port 98, enters the valve body through valve body port 182. This entering power gas is directed to an intermediate main valve cavity 150, formed around an intermediate portion of the main valve 42, and is directed to the lower pressure chamber 154 through the lower main valve passageway 184. The main valve seal 270, by being moved upward with the upward movement of the main valve 42, has provided communication between main valve port 191 and the intermediate main valve cavity 150.

In this shifted mode, a pair of spaced apart seal means 172*a* and 172*b*, carried on the lower portion of the pilot valve 166, seal off valve body exhaust port 190 and thus prevent exhaust gas from entering the exhaust gas weldment 97 through nipple port 180. Exhaust gas exiting the upper pressure chamber 156 now finds its way out of the valve body 42 only through nipple port 178. This path includes the valve body passageway 186, which provides communication between the upper pressure chamber 156 and a cavity 206 surrounding an upper portion of the main valve. This main valve cavity 206 is confined between seal means 274 and 270 carried on the upper portion of the main valve 200. From this cavity 206, the exhaust gas exits through an upper valve body port 204 and thence through upper exhaust zone valve body ports 176.

In FIG. 5, it is seen that in the downward shifted position, seal 270, on the main valve, has caused power gas entering the main valve through valve body port 191 to be directed into the upper main valve cavity 206 and thence into the upper valve body passageway 186 to the upper pressure chamber 156.

In FIG. 5, it is seen that in the downward shifted position, seal 270, on the main valve, has caused power gas entering the main valve through valve body port 191 to be directed into the upper main valve cavity 206 and thence into the upper valve body passageway 186 to the upper pressure chamber 156.

The preferred embodiment of the invention, illustrated in FIG. 7, is shown to have each of the pressure chambers 156 and 154 exhausting while the opposed pressure chamber is expanding with introduction of power gas entering therein via the lower valve body passageway 228. This is accomplished by alternatively and substantially simultaneously exposing opposite ends of the main valve to power gas and to exhaust pressure. This embodiment has been found to result in more uniform shifting from one cycle to the next with no dead spots. Preferably, the relationship of upper pilot valve seals 168*a* and 168*b* to port 234; and the relationship of lower pilot valve seals 172*a* and 172*b* to port 214 is such that as one port is uncovered the other is covered. Also, as these ports are covered and uncovered the intermediate seal 170 passes over port 216. Thus, at substantially the same time that each end of main valve 201 is subjected to power gas the other end is connected to vent pressure ensuring that main valve positively moves between its two extreme positions and remains at each position until it is caused to be shifted in the manner afore-explained.

While the general features of the double acting pump valve body 42 are essentially the same as those illustrated in the previous drawings, there are some significant different configurations.

The upper portion 208 (in FIG. 5) of the main valve cavity has been eliminated, in FIG. 7, except for a slight upper end space 240 extending beyond the upper end of the main valve 201. The upper end space 240 is in fluid communication, through an upper, lateral valve body passgeway 238, with an upper pilot valve cavity 236, which is confined between seals 168*b* and 170 carried on the pilot valve 166'.

In addition, seal 170 on the pilot valve 166' causes power gas entering the pilot valve cavity 232 to be confined below seal 170 and then directed to the space 188 between the lower end of the main valve 201 and a main valve stop means 207. Power gas acts to hold the main valve 201 in the upward position shown in FIG. 7 and allows the power gas to be directed through passageway port 226 and lower valve body passageway 228 to the lower pressure chamber 154. In like manner when the pilot valve is down, power gas flows to annulus 236, passage 238 and chamber 240 to force the main valve down.

The equalizing passageway 202 (FIG. 5) has been eliminated in the embodiment of the invention illustrated in FIG. 7. In addition, seal means 168*a* and 168*b* have been added to the upper end of the pilot valve 166'. In the embodiment of FIG. 5, the portion of the pilot valve 166 above seal means 174*a* was open to the pressure in the upper pressure chamber 156.

In the preferred embodiment of FIG. 7, the lower and upper halves of the valve body, main valve and the pilot valve are essentially mirror images. Power gas enters the valve body through valve body ports 220*a*. Reversal of position of main valves 201 occurs upon movement of the pilot valve 166' to a new, shifted position. As the pilot valve 166' moves seal 170 up valve body port 216 power gas enters the lower pilot valve cavity 232, traverses a lower, lateral valve body passageway 230 and enters the space 188 between the lower end of the main valve 201 and the lower main valve stop means 228. The main valve is thus shifted to its upper position, allowing entry of power gas to the lower pressure chamber 154, as described previously. In like manner, shifting of the pilot valve down to move seal 170 down past valve port 216 introduces power gas to the upper annulus 236, passage 238 and space 240.

In this configuration, the upper pressure chamber will commence to exhaust through valve body port 176*a*, on the upper portion of the valve body 42. The lower exhaust valve body port 214 has been blocked by seals 172*a'* and 172*b'*, carried on the pilot valve 166'.

Exhaust gas leaves the upper pressure chamber 156 through the upper valve body passageway 244 and enters the upper main valve cavity 225 by way of passageway port 242. This upper main valve cavity is formed between seals 274*b'* and 270', which are carried on the main valve. From the upper main valve cavity 225, the exhaust gas leaves the valve body, via valve body port 210, through valve body ports 176*a*. Seal 274*a'* isolates chamber 240 from port 210 at all positions of the main valve.

Gas trapped in the upper end 240 of the main valve cavity can escape therefrom through the lateral, upper valve body passageway 238 which communicates with the upper pilot valve cavity 236. This upper pilot valve cavity is in communication with the upper valve body exhaust port 176*a* by way of valve body port 234.

As will be readily appreciated by those skilled in the art, the valve assembly is the very heart of the double acting pump of the invention. It must be capable of operating for millions of cycles. Desirably, the valve assembly is capable of: (1) positive operation without any dead spots; (2) a minimum number of long wearing functional parts; and (3) ample pressure and volume capacity to operate the pump under all required well conditions.

In order to better understand the sequential operation of the valve assembly illustrated in FIG. 7, reference is made to the schematic drawings in FIGS. 8A, 8B and 8C. Represented therein is the valve assembly in the following cycles: (1) power gas being directed to pressure chamber 154 (FIG. 8A); (2) mid point between cycles (FIG. 8B); and (3) power gas being directed to pressure chamber 156 (FIG. 8C).

As in previous drawings, the piston rod 118*a* and 118*b* connects the two pistons (not shown). The pilot valve 167 has one end 162 extending into the pressure chamber 156, with the other end 164 extending into the pressure chamber 154. For purposes of correlation, presume chamber 154 is considered the "lower" pressure chamber.

The FIGS. 8A, 8B and 8C will be described in terms of operation of the valve assembly to demonstrate the sequence of both mechanical and pressure changes that effect the reversal of pressures in chambers 154 and 156.

Referring to FIG. 8A, the pilot valve 167 is shown positioned toward the upper pressure chamber 156. In this position the power gas is free to flow to the lower end 188 of the main valve 201. The upper end 204 is free to exhaust through the lateral passage 238 through the pilot valve cavity 236 and out through exit port 176*a*. The upper pressure chamber 156 is exhausting through upper passageway 244 into the upper main valve cavity 225 and out the upper valve body port 176*b*. The lower valve body exhaust port 212 is blocked by seals 272*a* and 272*b* carrid on the lower end of the main valve 201. In like manner, lower valve body exhaust port 214 is blocked by seals 172*a* and 172*b* carried on the lower portion of the pilot valve 167.

In this condition, the pressure differential is forcing the main valve 201 towards the upper pressure chamber 156. With the main valve 201 positioned towards the upper pressure chamber 156, the power gas is free to enter the lower pressure chamber 154, and the exhaust gas from the upper pressure chamber 156 is free to exhaust.

This forces the piston (not shown) in the lower pressure chamber 154 away from the valve assembly and moves the piston (not shown) in the upper pressure chamber 156 towards the valve assembly, since the pistons are connected to the piston rod 118*a* and 118*b*.

In FIG. 8B, the upper piston (not shown) has made contact with the upper end 162 of the pilot valve 167 and has moved the pilot valve 167 downwardly to a point where the power gas has been diverted, by seal 170 carried on the pilot valve 167, from the lower pilot valve cavity 232 to the upper pilot valve cavity 236. Thus, power gas is no longer reaching the lower end space 188 of the main valve 201 through the lateral valve body passageway 230. Instead, power gas is now being directed to the upper pilot valve cavity 236, through the upper lateral valve body passageway 238 to the upper end 204 of the main valve 201.

The pilot valve 167, by means of seals 168*a* and 168*b* carried thereon, has blocked off the upper exhaust valve body port 176*a* which communicates with the upper end 204 of the main valve 201, and has slightly opened the lower exhaust valve body port 214, which is in communication with the lower end 188 of the main valve 201.

At this moment, the pressures are changing across the main valve 201 and it remains in the same position. However, the power gas going to the lower pressure chamber 154 continues to drive the lower piston (not shown) away from the valve assembly and the upper piston (not shown) continues to move towards the valve assembly forcing the pilot valve 167 to be completely shifted to its most downward position.

This further opens power gas valve body port 220*a* permitting a full flow of power gas to the upper pilot valve cavity 236 and thence to the upper end 204 of the main valve 201. This full shift of the pilot valve 167 also opens the lower valve body exhaust port 214 allowing exhaust gas from the lower end 188 of the main valve 201 to pass therethrough, thus creating a differential pressure across the main valve 201 that shifts it towards the lower pressure chamber 154, as shown in FIG. 8C.

With the main valve in the position shown in FIG. 8C, the power gas is directed to the upper pressure chamber 156 and exhausts the lower pressure chamber 154. This reverses the movement of the pistons (not shown) until the lower piston (not shown) in the lower pressure chamber 154 makes contact with the lower end 164 of the pilot valve 167, reversing the sequence of operation of the pilot valve 167.

What is claimed is:

1. A downhole double-acting pump comprising a tubular housing, a valve body positioned in the intermediate portion of said tubular housing providing upper and lower body chambers within said housing, a piston positioned within each of said body chambers providing a pump chamber and a power chamber, means connecting the pistons, a power fluid inlet to the valve body, check valve means associated with said pump chambers to control movement of well fluids therethrough, said valve body having a closed main cylinder therein, a main valve member reciprocal in said cylinder and having an intermediate and first and second endwise seals, a fluid inlet port into said main cylinder in fluid communication with the power fluid inlet positioned such that as the main valve member reciprocates the intermediate seal passes said inlet port, first and second outlet ports in said main valve cylinder on opposite sides of said inlet port, passageways respectively connecting said upper and lower power chambers with said cylinder at points intermediate the inlet and outlet ports, said first and second endwise seals alternately connecting said passageways with said inlet port and one of said outlet ports, a pilot valve cylinder extending through said valve body and having an inlet in fluid communication with the power fluid inlet and outlets straddling said inlet, passageways extending respectively between each end of said main valve cylinder and the pilot valve cylinder intermediate the inlet and each outlet port of the pilot valve cylinder, a reciprocal pilot valve member in said pilot valve cylinder having an intermedate and first and second endwise resilient seals thereon, said pilot valve member in said pilot valve cylinder having an intermediate and first and second endwise resilient seals thereon, said pilot valve intermediate seal passing over the pilot valve inlet port with reciprocation of said pilot valve between first and second positions, said pilot valve intermediate and endwise seals alternately connecting said pilot valve inlet and outlets with respective ones of said passageways between the main and pilot valves, and resilient means carried by each of said pistons and engageable with said pilot valve as each piston approaches said valve body, at least one of said seals on said pilot valve member subject to the differential between the pilot valve inlet and a pilot valve outlet with the pilot valve in each of its first and second positions, said differential expanding said seal into engagement with said pilot valve cylinder and providing breakaway frictional engagement with the cylinder resisting movement of the pilot valve member from its at rest position when engaged by said resilient means until the resilient means exerts a greater force than the differential exerted by pressure in the two power chambers on the pilot valve member and the breakaway friction of said pilot valve seals and when the breakaway friction is overcome the pilot valve may be moved between its first and second positions by said resilient means with a snap action.

2. The pump of claim 1 where said intermediate and one of said endwise seals on the pilot valve member is subjected to a differential in each of its first and second positions.

3. A downhole double acting pump comprising a tubular housing adapted to be received and housed within a well tubing string, a valve body, positioned in said housing, forming an upper chamber above and a lower chamber below said valve body within said housing, a piston positioned within each of said chambers to provide in said upper chamber an upper pumping chamber and an upper pressure chamber, and in said lower chamber a lower pumping chamber and a lower pressure chamber, said upper and lower pumping chambers being in fluid communication with said tubing string above said pump, a piston rod reciprocally movable through said valve body connecting the pistons, said valve body having a closed main cylinder therein, a main valve member reciprocal in said cylinder and having an intermediate and first and second endwise seals thereon, a passageway in the main valve member interconnecting the exterior of the valve member between the intermediate and one endwise seal with the end of the valve member carrying the other endwise seal, a fluid inlet port into said main cylinder positioned such that as the main valve member reciprocates the intermediate seal passes said inlet port, first and second outlet ports in said cylinder on opposite sides of said inlet port, passageways respectively connecting said upper and lower pressure chambers with said cylinder at points intermediate the inlet and outlet ports, said intermediate and first and second endwise seals alternately connecting said passageways with said inlet ports and one of said outlet ports, a pilot valve cylinder extending through said valve body and having an inlet and an outlet, a passageway between the pilot valve cylinder and the end of the main valve cylinder adjacent the other endwise seal, a pilot valve member in said pilot valve cylinder having first and second seal means thereon, said pilot valve alternately connecting said pilot valve inlet and outlet with the main valve cylinder at its end adjacent the other main valve member endwise seal, resilient means carried by each of said pistons and engageable with said pilot valve as each piston approaches said valve body, and said pumping chambers having check valve means to control well liquids entering and exiting said chambers.

4. A downhole double-acting pump comprising a tubular housing including a valve body and upper and lower body chambers, a piston positioned with each of said body chambers providing a pump chamber and a power chamber, means connecting the pistons, a power fluid inlet and outlet to the valve body, check valve means associated with said pump chambers to control movement of well fluids therethrough, said valve body having a closed main cylinder therein with the passageway interconnecting the power fluid inlet and outlet with each power chamber, a main valve member reciprocal in said cylinder and alternately connecting each power chamber with the power fluid inlet and outlet, a pilot valve cylinder extending through said valve body and having an inlet in fluid communication with the power field inlet and outlets straddling said inlet, passageways extending respectively between each end of said main valve cylinder and the pilot wave cylinder intermediate the inlet and each outlet of the pilot valve cylinder, a reciprocal pilot wave member in said pilot valve cylinder having an intermediate and first and second endwise resilient seals thereon, said pilot valve member in said pilot valve cylinder having an intermediate and first and second endwise resilient seals thereon, said pilot valve intermediate seal passing over the pilot valve inlet port with reciprocation of said pilot valve between first and second positions, said pilot valve intermediate and endwise seals alternately connecting said pilot valve inlet and outlets with respective ones of said passageways between the main and pilot valves, and resilient means carried by each of said pistons and engageable with said pilot valve as each piston approaches said valve body, at least one of said seals on said pilot valve member subject to the differential between the pilot valve inlet and a pilot valve outlet with the pilot valve in each of its first and second positions, said differential expanding said seal into engagement with said pilot valve cylinder and providing breakaway frictional engagement with the cylinder resisting movement of the pilot valve member from its at rest position when engaged by said resilient means until the resilient means exerts a greater force than the differential exerted by pressure in the two power chambers on the pilot valve member and the breakaway friction of said pilot valve seals and when the breakaway friction is overcome the pilot valve may be moved between its first and second positions by said resilient means with a snap action.

5. The pump of claim 4 wherein said intermedite and one of said endwise seals on the pilot valve member is subjected to a differential in each of its first and second positions.

* * * * *

UNITED STATES PATENT AND TRADEMARK OFFICE

CERTIFICATE OF CORRECTION

PATENT NO. : 4,405,291

DATED : September 20, 1983

INVENTOR(S) : Carlos R. Canalizo

It is certified that error appears in the above-identified patent and that said Letters Patent is hereby corrected as shown below:

Column 12, cancel lines 27, 28 and 29 to delete the clause "said pilot valve member in said pilot valve cylinder having an intermediate and first and second endwise resilient seals thereon,".

Column 13, lines 35 and 40, change "other" to -- one --.

Column 14, cancel lines 21, 22 and 23 to delete the clause "said pilot valve member in said pilot valve cylinder having an intermediate and first and second endwise resilient seals thereon,".

Signed and Sealed this

*Fifteenth* Day of *May 1984*

[SEAL]

*Attest:*

GERALD J. MOSSINGHOFF

*Attesting Officer*

*Commissioner of Patents and Trademarks*